US007448312B2

(12) United States Patent
Friedrich

(10) Patent No.: US 7,448,312 B2
(45) Date of Patent: Nov. 11, 2008

(54) HYDRAULIC SWIVEL DRIVE FOR A GRAB

(75) Inventor: Thomas Friedrich, Waakirchen (DE)

(73) Assignee: Kinshofer GmbH, Waakirchen (DE)

( * ) Notice: Subject to any disclaimer, the term of this patent is extended or adjusted under 35 U.S.C. 154(b) by 354 days.

(21) Appl. No.: 11/010,702

(22) Filed: Dec. 13, 2004

(65) Prior Publication Data

US 2005/0158186 A1 Jul. 21, 2005

(30) Foreign Application Priority Data

Dec. 11, 2003 (DE) ..... 203 19 227 U

(51) Int. Cl.
*F01B 9/06* (2006.01)

(52) U.S. Cl. ..... 92/117 R; 92/136

(58) Field of Classification Search ..... 92/33, 92/117 R, 117 A, 136
See application file for complete search history.

(56) References Cited

U.S. PATENT DOCUMENTS 829,279 A * 8/1906 Mears ..... 92/33
2,678,519 A * 5/1954 Honiss ..... 92/136
3,192,783 A * 7/1965 Cruzan ..... 92/33
5,651,302 A * 7/1997 Mills ..... 92/117 A

FOREIGN PATENT DOCUMENTS

| | | |
|---|---|---|
| DE | 1864451 | 12/1962 |
| DE | 29621601 | 4/1998 |
| DE | 20107206 | 8/2002 |

* cited by examiner

*Primary Examiner*—F. Daniel Lopez
(74) *Attorney, Agent, or Firm*—Dilworth & Barrese, LLP

(57) ABSTRACT

The invention relates to a hydraulic swivel drive for a grab which has two tong-like movable grab arms, in particular two-shell grabs, having two swivel shafts which are pivotally supported in a shell carrier, are parallel to one another and whose shaft ends can be connected to the grab arms, as well as a shaft drive piece which is displaceably supported parallel to the swivel shafts and is in screw engagement with both swivel shafts so that the swivel shafts are rotated in opposite directions by displacement of the shaft drive piece. In accordance with the invention, the swivel drive is characterized in that at least one hydraulically chargeable plunger piston is provided to displace the shaft drive piece.

21 Claims, 6 Drawing Sheets

HYDRAULIC SWIVEL DRIVE FOR A GRAB

BACKGROUND OF THE INVENTION

The present invention relates to a hydraulic swivel drive for a grab which has two tong-like movable grab arms, in particular a two-shell grab, having two swivel shafts which are pivotally supported in a shell carrier, are parallel to one another and whose shaft ends are connectable to the grab arms, and having a shaft drive piece which is displaceably supported parallel to the swivel shafts and is in screw engagement with each of the two swivel shafts such that the swivel shafts are rotated in opposite directions by displacement of the shaft drive piece.

Such a swivel drive for a two-shell grab is known from DE 201 07 206 U1 in which the respective swivel shafts are part of a hydraulic motor which is surrounded by the shell carrier made as a closed housing. Tubular pieces are respectively seated on the two swivel shafts which swivel the grab arms or grab shells open and closed, with said tubular pieces being guided longitudinally displaceably, but rotationally fixedly and being in screw engagement with the respective swivel shaft such that a longitudinal displacement of the tubular pieces results in a rotation of the swivel shafts. The tubular pieces are connected by a common center piece with which they together form a piston which is received in the interior of the housing which forms the cylinder for the piston. The housing bounds a respective pressure space at both sides of this piston which can be charged with hydraulic fluid. Depending on which of the two pressure spaces is charged with hydraulic fluid, the piston and the tubular pieces provided thereon moves in the one or the other direction so that the swivel shafts swivel the grab shells secured thereto either open or closed.

Although the already known swivel drive for grabs has large advantages, is in particular very compact and small in construction and is protected from the rough surrounding influences during construction site operation due to the encapsulated construction of the hydraulic motors, it is capable of improvement in a plurality of aspects. On the one hand, only a limited center distance of the swivel shafts can be realized with this already known swivel drive. If the swivel shafts should have a large spacing from one another predetermined for the corresponding type of grab shells, very large forces arise on the pressure loading of the shaft drive piece acting as the piston which can hardly be mastered, and which the housing can hardly withstand with a reasonable construction design. On the other hand, this already known swivel drive requires expensive and complex sealings of the swivel drive piece acting as a piston with respect, first, to the swivel shafts and, second, to the housing.

SUMMARY OF THE INVENTION

It is therefore the underlying object of the present invention to provide an improved swivel drive of the said type which avoids disadvantages of the prior art and further develops the latter in an advantageous manner. A larger center distance of the swivel shafts should preferably be able to be provided with a simple construction design.

This object is solved in accordance with the invention by a swivel drive in accordance with the description herein. Preferred aspects of the invention are also the subject of the description herein.

The swivel drive is therefore characterized in accordance with the invention in that the shaft drive piece, which is in screw engagement with the swivel shafts, is driven by at least one hydraulically loadable plunger piston. The whole shaft drive piece no longer forms the piston charged with hydraulic fluid so that the housing correspondingly no longer has to work and be designed as a cylinder for the shaft drive piece. A very much smaller pressure chamber from the volume aspect is achieved by the at least one plunger piston interposed between the shell carrier and the shaft drive piece so that only comparatively low forces act and have to be brought under control even with a large center distance of the swivel shafts. In addition, the sealing of the pressure chamber is substantially easier. A seal between the shaft drive piece and the swivel shafts can also be omitted, as can a seal between the shaft drive piece and the shell carrier taking up the total assembly. It is sufficient for only the plunger piston to be sealed with respect to the pressure chamber acting on the piston.

In a preferred embodiment of the invention, the pressure chamber acting on the plunger piston is provided in the shaft drive piece. The plunger piston can be seated displaceably in a cylindrical recess, in particular a circular cylindrical recess, in the shaft drive piece and be supported at an end section projecting from the recess with respect to the shell carrier. To achieve a particularly compact assembly of short construction, the plunger piston can be supported at its end projecting from the recess directly at the inner wall of the shell carrier. It is understood that here intermediate pieces can also be interposed such as piston rods and the like.

It would generally also be possible not to arrange the pressure chamber acting on the plunger piston in the shaft drive piece, but in the shell carrier. The plunger piston is in this case displaceably seated in a cylindrical recess in the shell carrier and is supported with respect to the shaft drive piece such that a displacement of the plunger piston in the cylindrical recess in the shell carrier correspondingly displaces the shaft drive piece. The reverse assembly, previously described, with the displaceable reception of the plunger piston in the shaft drive piece, however, has the advantage of a compact assembly with a simplified shape of the shell carrier.

To be able to drive the swivel shafts in both directions and to be able to swivel the grab arms open and closed, the at least one plunger piston can be made with a double action. For this purpose, it can be seated in the cylindrical recess in the manner of a dual-action hydraulic cylinder such that a pressure chamber is bounded on both sides of the piston and is supported, for example, at both sides at the shell carrier via piston rods projecting out of the chamber. Preferably, however, a plurality of plunger pistons each acting on one side are provided of which one serves the displacement of the shaft drive piece in a first direction and another serves the displacement of the shaft drive piece in the opposite direction.

In accordance with a further preferred embodiment of the invention, a pair of first plunger pistons and a pair of second plunger pistons are provided. The said pair of first plunger pistons serves the displacement of the shaft drive piece in a first direction corresponding to a swiveling open of the grab arms. The said pair of second plunger pistons serves the displacement of the shaft drive piece in a second direction corresponding to a swiveling together of the grab arms. Sufficient cross-sectional areas of the pressure chambers to produce the required torques can be achieved by the provision of a plurality of plunger pistons in each case for the displacement of the shaft drive piece in one direction with simple plunger pistons circular in cross-section. To achieve a uniform action on the plunger pistons acting in one direction, the pressure chambers associated with the first plunger pistons and the pressure chambers associated with the second plunger pistons are each connected parallel to one another so that the same pressure prevails in the two pressure chambers.

In a further advantageous embodiment of the invention, the first plunger pistons and the second plunger pistons are each arranged symmetrically to a plane which forms the symmetry plane to the two swivel shafts. A jamming of the shaft drive piece is thereby prevented. Equal forces act on both swivel shafts. In a further development of the invention, the first plunger pistons are spaced apart from one another perpendicular to a straight line connecting the two swivel shafts. The second plunger pistons are advantageously spaced apart from one another parallel to the straight line connecting the two swivel shafts.

The plunger pistons can generally all have the same cross-sectional area. The plunger pistons preferably have different cross-sectional areas, however. In particular, the plunger pistons bringing about the pivoting together of the grab arms can have a larger cross-sectional area than the plunger pistons which bring about the pivoting open of the grab arms. Larger forces for the pivoting together of the grab can be achieved with the same hydraulic pressure by the overall larger cross-sectional area of the plunger piston(s) for the swiveling together.

In a further preferred embodiment of the invention, the shaft drive piece has two engagement sections, which are each provided with a toothed arrangement with an internal thread and which are each seated on one of the swivel shafts, and a center piece which connects the two engagement sections and at which the at least one plunger piston engages. In particular a plurality of cylindrical recesses can be formed in the center piece which are open toward opposite sides of the centre piece and which each receive a plunger piston. The arrangement of a plurality of plunger pistons offset with respect to one another is particularly advantageous, since the cylindrical recesses can overlap one another in depth. In other words, the center piece does not need to accept twice the depth of the cylindrical recesses for the plunger piston so that an assembly of particularly short design can be achieved.

The shell carrier is preferably made as a closed housing from which essentially only the shaft ends of the swivel shafts project. The remaining sections and components of the swivel drive can be arranged on the interior of the closed housing so that an encapsulated construction is achieved overall which protects the swivel drive from external surrounding effects. The housing can advantageously consist of two end walls substantially perpendicular to the longitudinal axes of the swivel shafts and of two housing half-shells which connect the end walls to one another. The end walls preferably have support surfaces for the plunger pistons on their inner sides.

The shaft drive piece can be spaced apart from the housing walls by a gap. The shaft drive piece can in particular be free of seals toward the housing. The seals between the shaft drive piece and the swivel shafts can likewise be omitted.

To be able to charge the pressure chambers formed in the center piece of the shaft drive piece for the plunger pistons with hydraulic fluid, the shaft drive piece has suitable pressure connections which are connectable to the hydraulic supply of the lifting gear supporting the grab.

BRIEF DESCRIPTION OF THE DRAWINGS

The invention will be explained in more detail in the following with reference to a preferred embodiment and to associated drawings. There are shown in the drawings.

DESCRIPTION OF THE PREFERRED EMBODIMENTS

Figure 1:
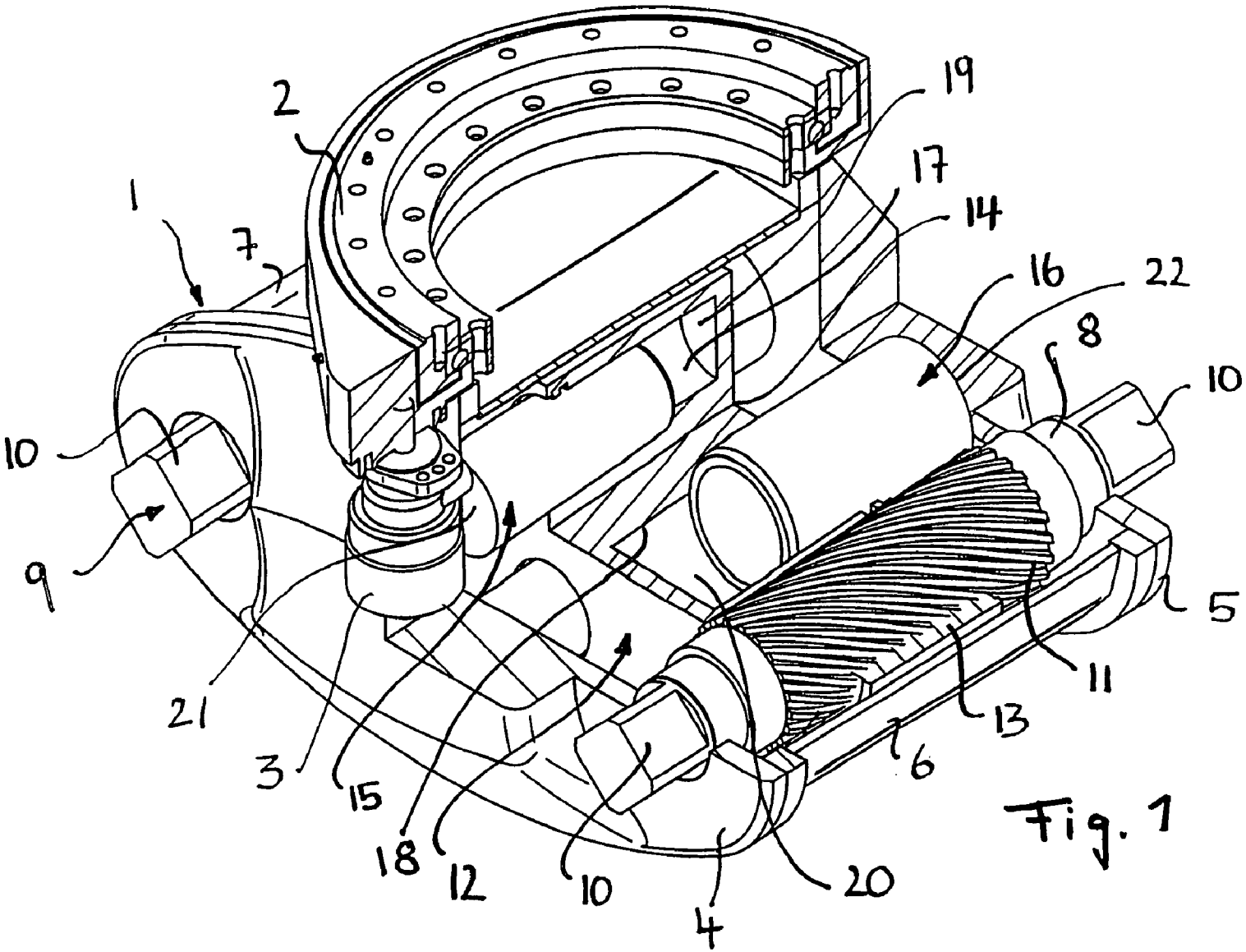
FIG. 1 a perspective partially sectional view of a swivel drive for a two-shell grab in accordance with a preferred embodiment of the invention in which one of the swivel shafts and two of the plunger pistons of the hydraulic drive for the rotation of the swivel shafts are cut open.

The swivel drive shown in the drawings comprises a shell carrier 1 which is made as a housing and can be coupled in a manner usual per se to the stem of an excavator or to another lifting gear. As FIG. 1 shows, the shell carrier 1 can have a ring-shaped rotary bearing 2 at its upper side and a rotary drive 3 associated with the former to be able to rotate the grab about an upright axis.

The shell carrier 1 comprises two end walls 4 and 5 which are parallel to one another and are connected to one another by two housing half-shells 6, 7 which extend substantially perpendicular to the end walls 4 and 5 (cf. FIG. 1). The two end walls 4 and 5 have a substantially elliptical shape and, together with the housing half-shells 6 and 7, bound a cylindrical interior space which is substantially elliptical in section.

Two swivel shafts 8 and 9 are arranged at the interior of the housing formed by the shell carrier 1 and are arranged parallel to one another and spaced apart from one another. The two swivel shafts 8 and 9 are supported rotatably in the end walls 4 and 5, but are axially fixedly supported and their spigot-shaped shaft ends project out of the housing. Grab shells, which are not shown in the drawing, can be coupled rotationally fixedly to the spigot-shaped shaft ends 10 in a manner known per se such that the grab shells can be swiveled open and closed by rotating of the swivel shafts 8 and 9.

As FIG. 1 shows, the swivel shafts 8 and 9 are provided with a screw-shaped toothed arrangement 11 on their section lying in the interior of the shell carrier 1.

A shaft drive piece 12 is in engagement with both swivel shafts 8 and 9, is arranged on the interior of the shell carrier 1 and is displaceably supported parallel to the longitudinal axes of the swivel shafts 8 and 9. The shaft drive piece 12 comprises tubular engagement sections 13 at opposite ends which are seated on the swivel shafts 8 and 9 and each have a screw-shaped internal toothed arrangement which are in screw engagement with the respective toothed arrangement 11 of the swivel shafts 8 and 9. When the shaft drive piece 12 is displaced in the direction parallel to the swivel shafts 8 and 9, the swivel shafts 8 and 9 are driven in a rotary manner in opposite directions, whereby the grab shells secured to the shaft ends 10 swivel open and closed.

Figure 2:
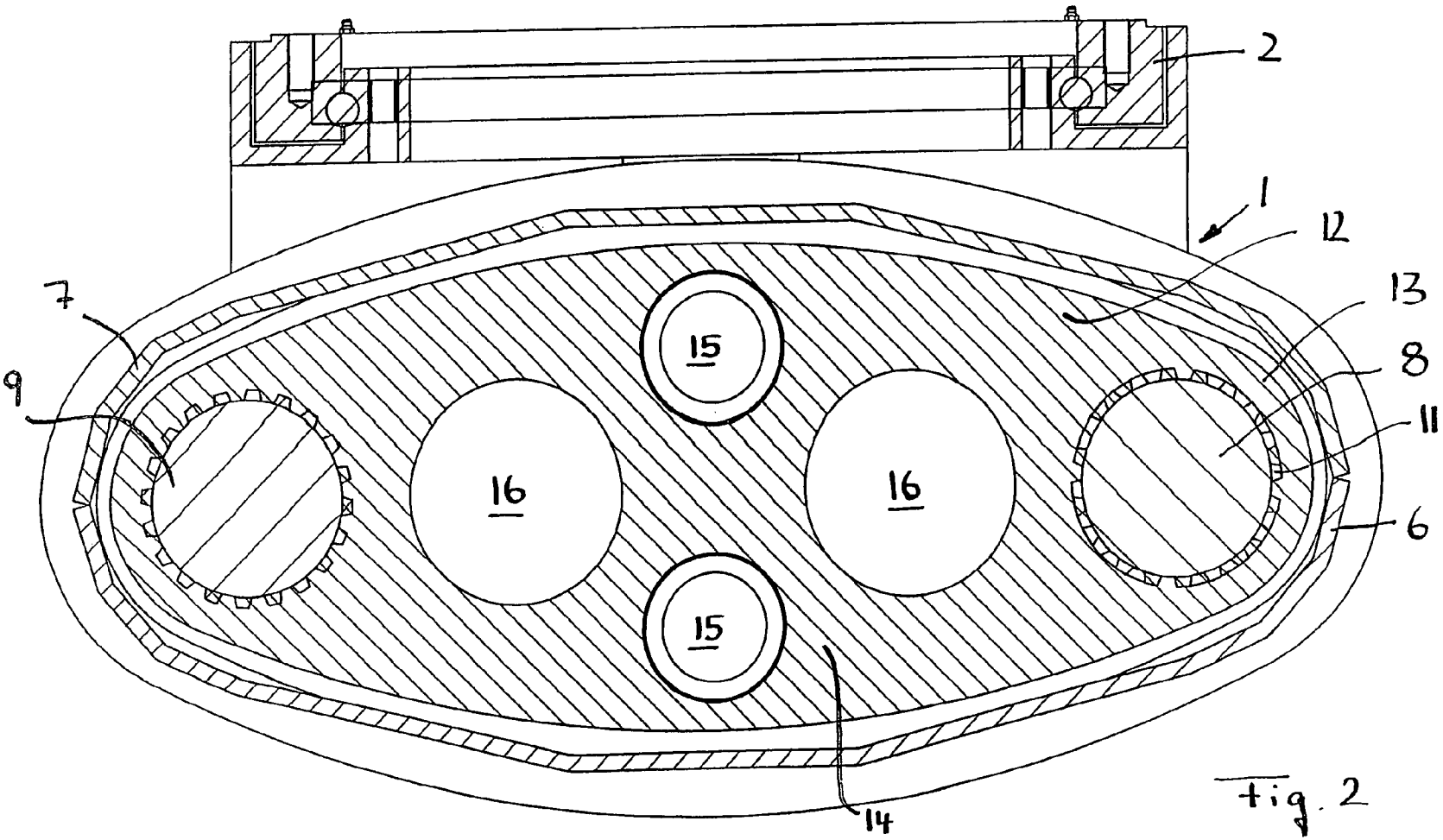
FIG. 2 a vertical longitudinal section perpendicular to the swivel shafts through the swivel drive of FIG. 1.
Figure 3:
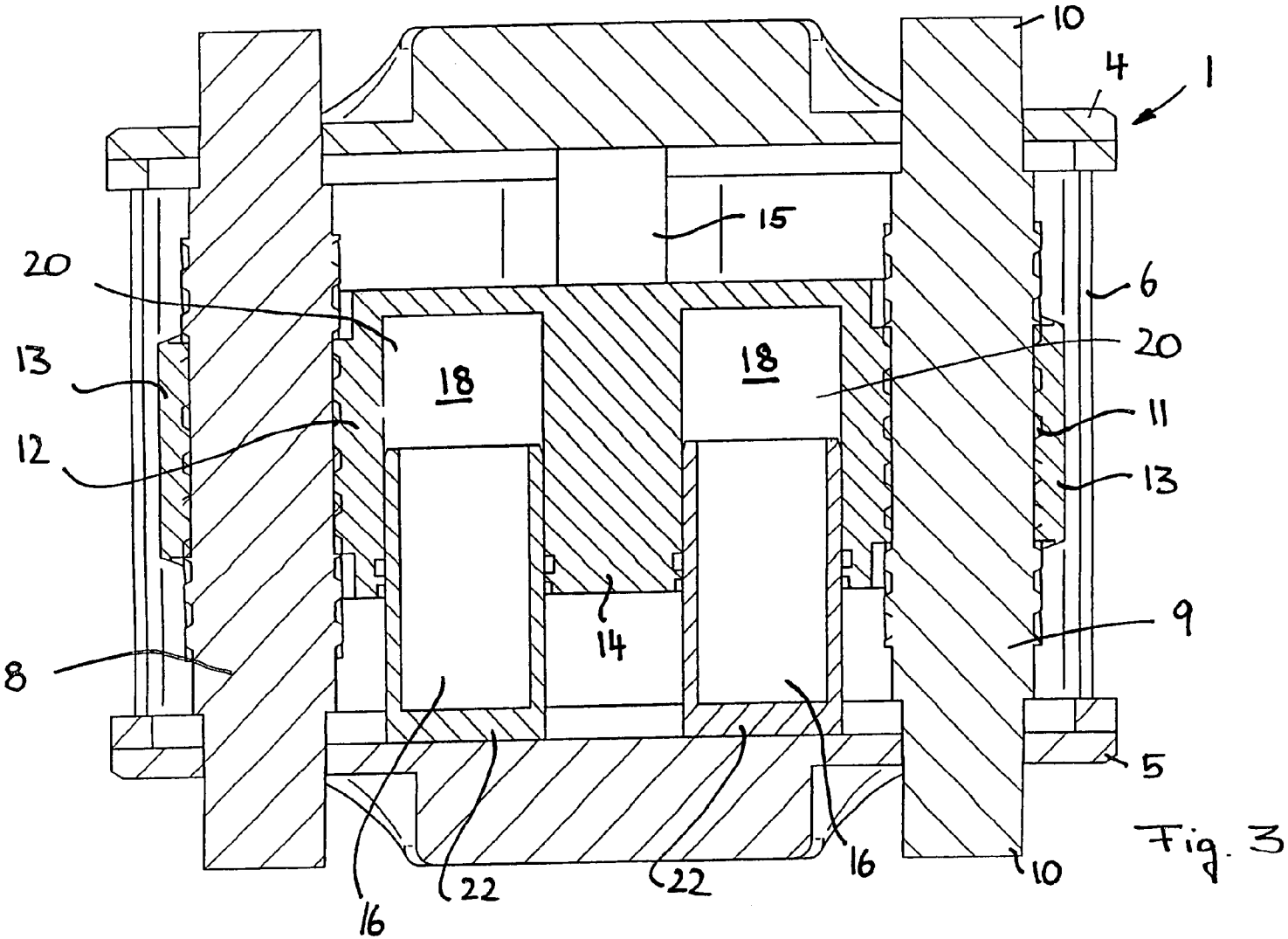
FIG. 3 a horizontal longitudinal section through the drive of the preceding Figures which, containing the sectional plane, shows the two swivel shafts.
Figure 4:
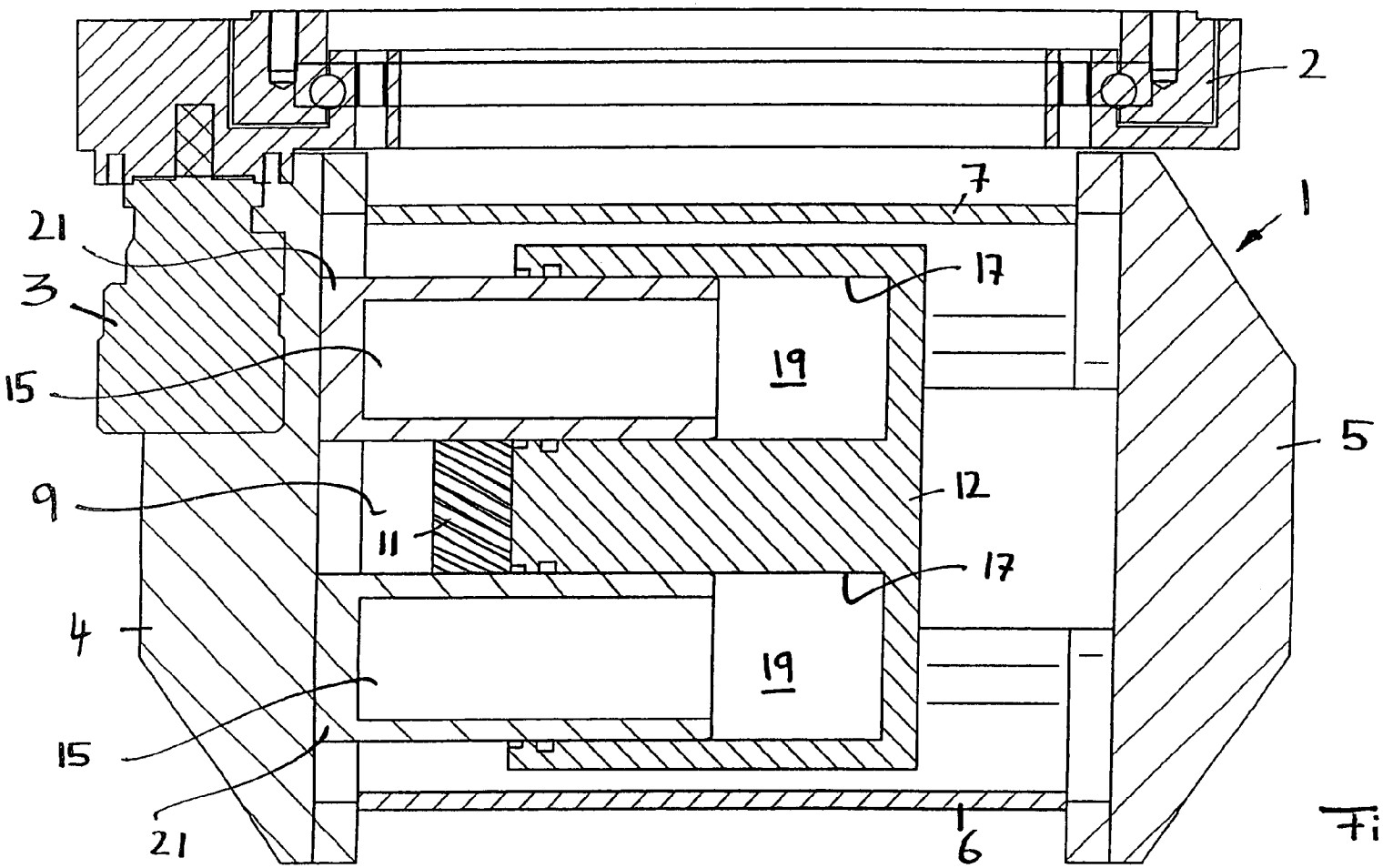
FIG. 4 a vertical cross-section parallel to the swivel shafts which shows a sectional plane which corresponds to the symmetry plane between the two swivel shafts.
Figure 5:
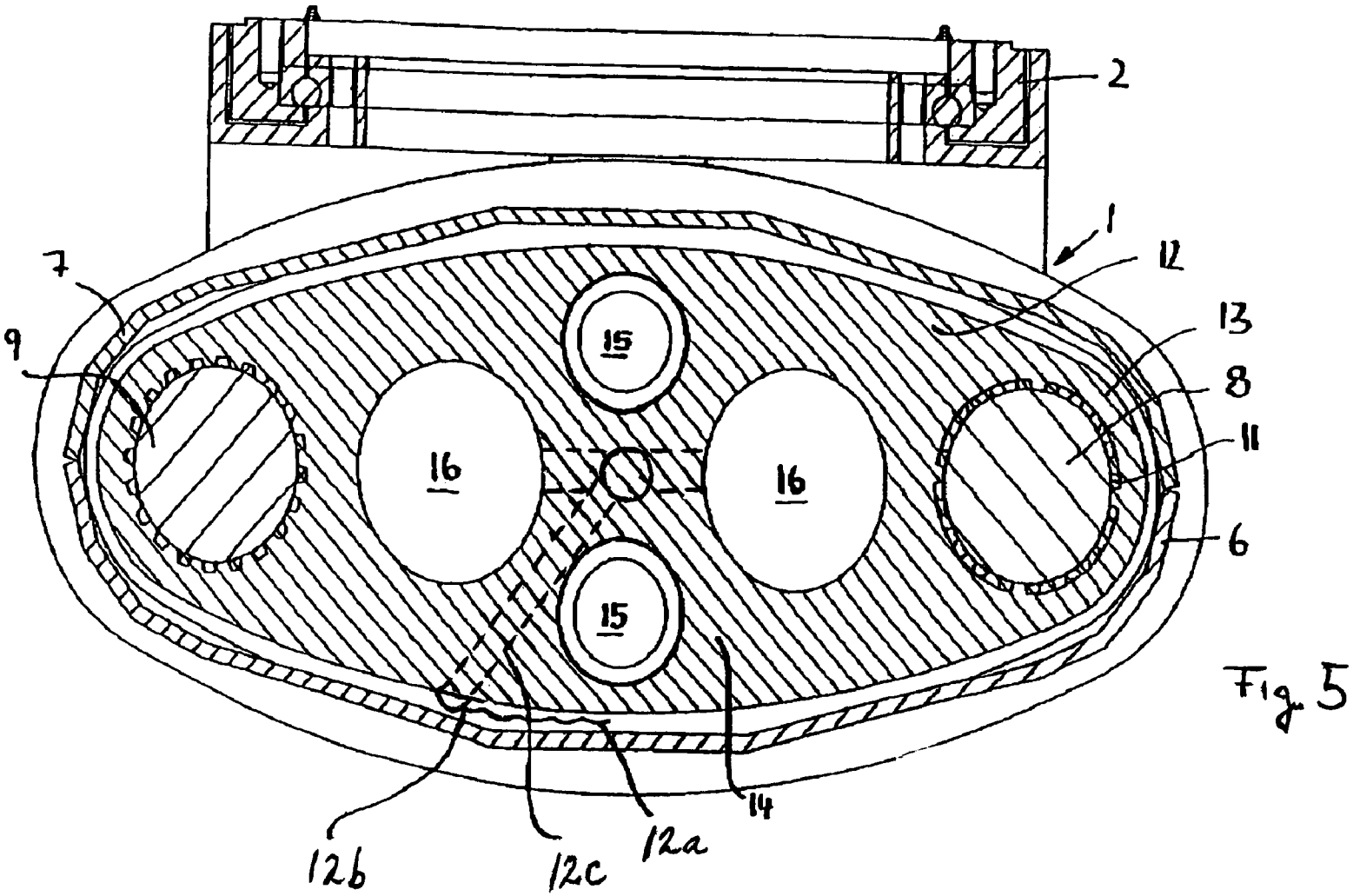
FIG. 5 an alternate embodiment of a vertical longitudinal section perpendicular to the swivel shafts through the swivel drive of FIG. 1.
Figure 6:
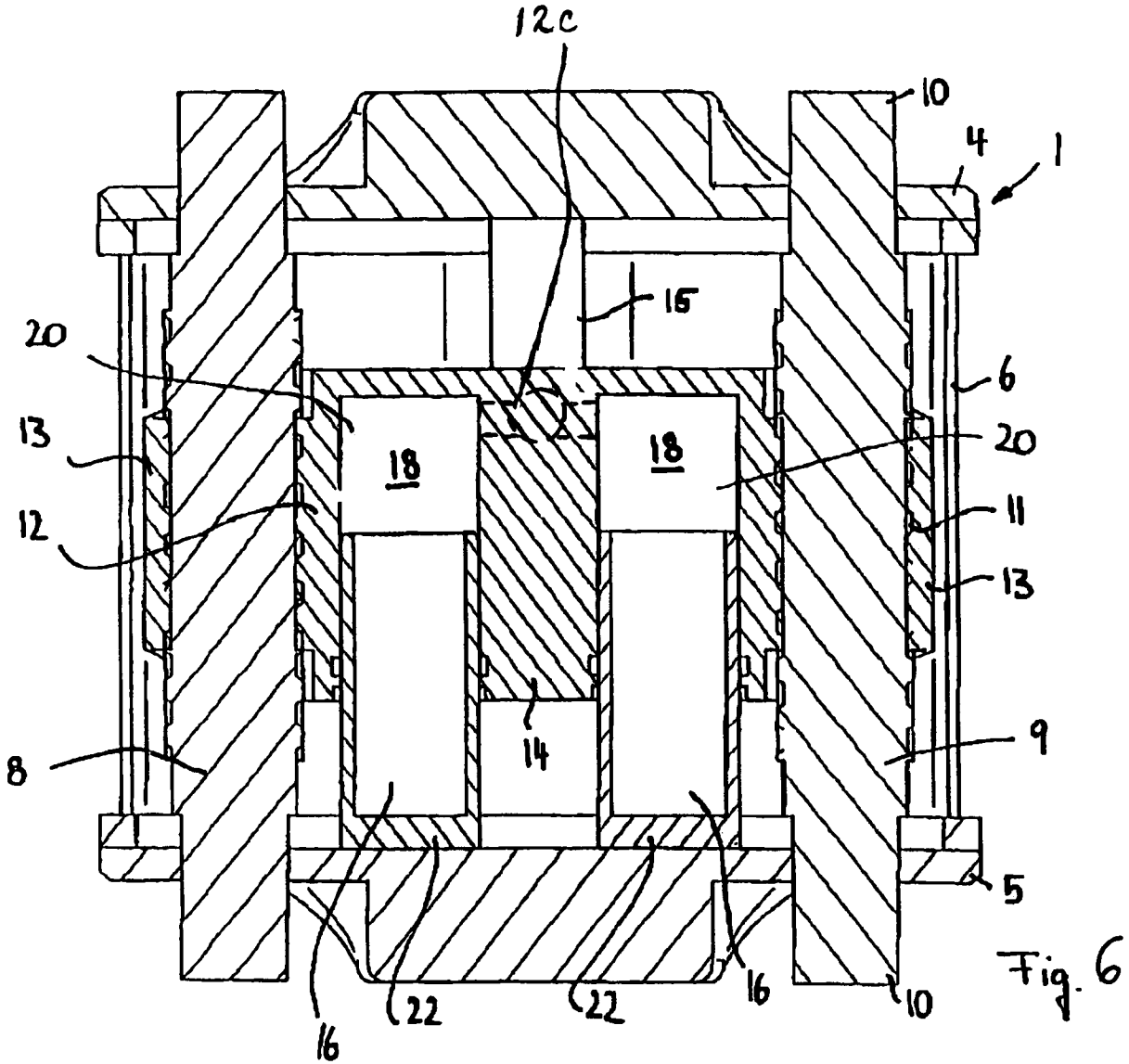
FIG. 6 an alternate embodiment of a horizontal longitudinal section through the drive of the preceding Figures which, containing the sectional plane, shows the two swivel shafts.

As FIGS. 2 and 3 show, the engagement sections 13 of the shaft drive piece 12 are connected to one another, and indeed by the center piece 14 of the shaft drive piece 12. The shaft drive piece 12 can be an integrally one-piece cast part. Alternatively, the shaft drive piece 12 can be a welded piece of a sheet metal section.

To be able to displace the shaft drive piece 12 and hereby to drive the swivel shafts 8 and 9 in a rotary manner, a plurality of plunger pistons are provided which act on the said center piece 14 of the shaft drive piece 12. As FIG. 2 shows, a total of four plunger pistons are provided which are arranged cross-wise and which each extend parallel to the swivel shafts.

Two first plunger pistons 15 are arranged vertically on top of one another in the symmetry plane of the swivel shaft drive in the drawn embodiment. Two second plunger pistons 16 are arranged spaced from one another perpendicular to the said symmetry plane in a plane which also includes the two swivel shafts 8 and 9. The second plunger pistons 16 have, as FIG. 2 shows, a somewhat larger cross-section than the first plunger pistons 15. Both first plunger pistons 15 have the same cross-section. The two second plunger pistons 16 likewise have the same cross-section.

The plunger pistons 15 and 16 are each made in circular cylindrical form and are inserted in circular cylindrical recesses 17 and 18 which are each formed as blind holes in the center piece 14 of the shaft drive piece 12. The said cylinder recesses 17 and 18, together with the end faces of the plunger pistons 15 and 16 seated in the recesses, bound pressure chambers 19 and 20 respectively (cf. FIG. 1) which can be charged with pressure fluid to displace the plunger pistons 15 and 16 respectively relative to the shaft drive piece 12. The pressure chambers 19 and 20 can be charged with pressure fluid from the external hydraulic supply 12 *a* via pressure connections including connection 12 *b* and bore 12 *c*. The pressure fluid supply and removal into and out of the pressure chambers 19 and 20 can take place through the walls of the cylinder recesses 17 and 18 or also through the plunger pistons.

The plunger pistons 15 and 16 have an end section 21 and 22 respectively exiting from the cylinder recesses 17 and 18, each end section being supported with respect to the respective end wall 4 or 5, in particular abutting directly thereat. As FIG. 1 shows, the cylinder recesses 17 and 18 are open toward opposite sides of the shaft drive piece 12 so that all first plunger pistons 15 are supported at the one end wall 4, whereas all second plunger pistons 16 are supported at the opposite end wall 5 of the shell carrier 1. The support of the plunger pistons 15 and 16 has the effect that, when the pressure chambers 19 or 20 are charged, the plunger pistons 15 or 16 are not moved, but that rather the shaft drive piece 12 is displaced accordingly.

As FIGS. 1 and 2 show, the shaft drive piece 12 does not have to be sealed either with respect to the swivel shafts 8 and 9 or with respect to the walls of the shell carrier 1, since it is no longer the space between the shaft drive piece 12 and the shell carrier 1 which serves as a pressure space. Only the plunger pistons 15 and 16 are seated in a hydraulically sealed manner in the respective cylinder recess 17 and 18. As FIG. 1 shows, suitable sealing means, for example in the form of sealing rings, can be arranged at the wall of the respective recess toward the open end of the cylinder recesses 17 and 18. Alternatively or additionally, corresponding sealing means, for example in the form of sealing rings, can be provided at the periphery of the plunger pistons to their end seated in the recess.

The invention claimed is:

1. A hydraulic swivel drive for a grab which has two tong-like moveable grab arms, said hydraulic swivel drive having two swivel shafts (8, 9) which are pivotally supported in a shell carrier (1), parallel to one another and whose shaft ends (10) can be connected to the grab arms, a shaft drive piece (12), which comprises a plurality of recesses (17, 18), is displaceably supported parallel to the swivel shafts (8, 9) and in screw engagement with both swivel shafts (8, 9) such that the swivel shafts (8, 9) are rotated in opposite directions by displacement of the shaft drive piece (12), and a plurality of hydraulically driven plunger pistons (15, 16) provided in a respective recess (17, 18) and fixedly supported with the shell carrier (1,) said recess (17, 18) together with an end face of said pistons (15, 16), define a plurality of pressure chambers (19, 20) arranged to be charged with pressure fluid to displace the shaft drive piece (12) relative to said pistons (15, 16), and wherein the shaft drive piece (12) defines a fluid pressure supply bore configured to collectively supply the pressure fluid to the plurality of pressure chambers (19, 20).

2. A swivel drive in accordance with claim 1, wherein the plunger piston (15, 16) is displaceably received in the cylindrical recess (17,18) in the shaft drive piece (12) with an end section (21, 22) projecting out of the recess (17, 18) and supported with respect to the shell carrier (1).

3. A swivel drive in accordance with claim 2, wherein the pistons include at least one first plunger piston (15) provided to displace the shaft drive piece (12) in a first direction corresponding to a swiveling open of the grab arms and at least one second plunger piston (16) provided to displace the shaft drive piece (12) in a second direction corresponding to a swiveling together of the grab arms.

4. A swivel drive in accordance with claim 3, wherein the at least one first plunger piston (15) includes a pair of first plunger pistons (15) and the at least one second plunger piston (16) includes a pair of second plunger pistons (16).

5. A swivel drive in accordance with claim 3, wherein second plunger piston (16) is arranged symmetrically to a first plane passing through the swivel shafts (8, 9), and the first plunger piston (15) is arranged symmetrically to a second plane normal to the first plane.

6. A swivel drive in accordance with claim 3, wherein the first plunger piston (15) is provided having a smaller cross-section area than the second plunger piston (16).

7. A swivel drive in accordance with claim 2, wherein the shaft drive piece (12) has two preferably tubular engagement sections (13) which are each provided with an internal thread toothed arrangement and each are seated on one one of the swivel shafts (8, 9) and a center piece (14) which connects the two engagement sections (13) and at which the at least one plunger piston (15, 16) engages.

8. A swivel drive in accordance with claim 1, wherein the plurality of hydraulically driven plunger pistons include a first plunger piston (15) provided to displace the shaft drive piece (12) in a first direction corresponding to a swiveling open of the grab arms and a second plunger piston (16) is provided to displace the shaft drive piece (12) in a second direction corresponding to a swiveling together of the grab arms.

9. A swivel drive in accordance with claim 8, wherein a pair of first plunger pistons (15) and/or a pair of second plunger pistons (16) are provided

10. A swivel drive in accordance with claim 9, wherein the shaft drive piece (12) has two preferably tubular engagement sections (13) which are each provided with an internal thread toothed arrangement and each are seated on one of the swivel shafts (8, 9) and a center piece (14) which connects the two engagement sections (13) and at which the at least one plunger piston (15, 16) engages.

11. A swivel drive in accordance with claim 8, wherein the second plunger piston (16) is arranged symmetrically to a first plane passing through the swivel shafts (8, 9), and the first plunger piston (15) is arranged symmetrically to a second plane normal to the first plane.

12. A swivel drive in accordance with claim 11, wherein the shaft drive piece (12) has two preferably tubular engagement sections (13) which are each provided with an internal thread toothed arrangement and each are seated on one of the swivel shafts (8, 9) and a center piece (14) which connects the two engagement sections (13) and at which the at least one plunger piston (15, 16) engages.

13. A swivel drive in accordance with claim 8, wherein the first plunger piston (15) is provided having a smaller cross-section area than the second plunger piston (16).

14. A swivel drive in accordance with claim 13, wherein the shaft drive piece (12) has two preferably tubular engagement sections (13) which are each provided with an internal thread toothed arrangement and each are seated on one of the swivel shafts (8, 9) and a center piece (14) which connects the two engagement sections (13) and at which the at least one plunger piston (15, 16) engages.

15. A swivel drive in accordance with claim 8, wherein the shaft drive piece (12) has two preferably tubular engagement sections (13) which are each provided with an internal thread toothed arrangement and each are seated on one of the swivel shafts (8, 9) and a center piece (14) which connects the two engagement sections (13) and at which the at least one plunger piston (15, 16) engages.

16. A swivel drive in accordance with claim 1, wherein the shaft drive piece (12) has two preferably tubular engagement sections (13) which are each provided with an internal thread toothed arrangement and each are seated on one of the swivel shafts (8,9) and a center piece (14) which connects the two engagement sections (13) and at which the at least one plunger piston (15, 16) engages.

17. A swivel drive in accordance with claim 1, wherein the shaft drive piece (12) is made free of seals toward the shell carrier (1) and toward the swivel shafts (8, 9).

18. A swivel drive in accordance with claim 1, wherein the shell carrier (1) is made as a closed housing form which substantially only the shaft ends (10) of the swivel shafts (8, 9) project, with the housing having two end walls (4, 5) which are substantially perpendicular to the longitudinal axes of the swivel shafts (8, 9), which are connected to one another by two housing half-shells (6, 7) and have at least one support surface for the at least one plunger piston (15, 16).

19. A swivel drive in accordance with claim 1, wherein the shaft drive piece (12) has pressure connections via which the pressure chambers (19, 20) provided between the shaft drive piece (12) and the pistons (15,16) can be charged with pressure fluid.

20. A swivel drive in accordance with claim 1, wherein said pistons (15, 16) are arranged to move relative to the shaft drive piece (12).

21. A hydraulic swivel drive for a grab which has two tong-like moveable grab arms, said hydraulic swivel drive having two swivel shafts (8, 9) which are pivotally supported in a shell carrier (1), parallel to one another and whose shaft ends (10) can be connected to the grab arms, a shaft drive piece (12) which is displaceably supported parallel to the swivel shafts (8, 9) and in screw engagement with both swivel shafts (8, 9) such that the swivel shafts (8, 9) are rotated in opposite directions by displacement of the shaft drive piece (12), and a plurality of hydraulically driven plunger pistons (15, 16) are provided to displace the shaft drive piece (12), wherein the plunger pistons(15, 16) are displaceably received in a cylindrical recesses (17, 18) in the shaft drive piece (12) and whose end sections projecting out of the recesses (17, 18) is are fixedly supported with respect to the shell carrier (1), the plurality of pistons include a first plunger piston (15) provided in a recess 17 and together define a pressure chamber 19, which is configured to be charged with pressure fluid to displace the shaft drive piece (12) in a first direction, relative to the piston 15, corresponding to a swiveling open of the grab arms and a second plunger piston (16) provided in a recess 18 and together define a pressure chamber 20, which is configured to be charged with pressure fluid to displace the shaft drive piece (12) in a second direction, relative to the piston 16, corresponding to a swiveling together of the grab arms, and the shaft drive piece (12) has two perfectly tubular engagement sections (13) which are each provided with an internal thread toothed arrangement and each are seated on one of the swivel shafts (8, 9) and a center piece (14) which connects the two engagement sections (13) and at which the at least one plunger piston (15, 16) engages, wherein the shaft drive piece (12) defines a fluid pressure supply bore configured to collectively supply the pressure fluid to the pressure chambers (19, 20).

* * * * *